US009679463B1

(12) United States Patent
Clark

(10) Patent No.: US 9,679,463 B1
(45) Date of Patent: Jun. 13, 2017

(54) REMOTE CONTROL-FINDING DEVICE

(71) Applicant: Tanasia Clark, Kissimmee, FL (US)

(72) Inventor: Tanasia Clark, Kissimmee, FL (US)

( * ) Notice: Subject to any disclaimer, the term of this patent is extended or adjusted under 35 U.S.C. 154(b) by 0 days.

(21) Appl. No.: 14/861,093

(22) Filed: Sep. 22, 2015

(51) Int. Cl.
*G08B 1/08* (2006.01)
*G08B 21/24* (2006.01)
*G08C 17/02* (2006.01)

(52) U.S. Cl.
CPC ..... *G08B 21/24* (2013.01); *G08C 17/02* (2013.01); *G08C 2201/50* (2013.01)

(58) Field of Classification Search
None
See application file for complete search history.

(56) References Cited

U.S. PATENT DOCUMENTS

D346,339 S 4/1994 Lintick
5,598,143 A 1/1997 Wentz
5,939,981 A * 8/1999 Renney ..... G08B 21/0227 340/407.1
5,952,918 A 9/1999 Ohayon
6,445,290 B1 9/2002 Fingal
6,573,832 B1 6/2003 Fugere-Ramirez
6,989,748 B2 * 1/2006 Rabanne ..... G01S 19/17 340/539.32
7,642,912 B2 1/2010 Sholem
8,942,719 B1 * 1/2015 Hyde ..... G01S 5/0231 455/411
2004/0217859 A1 * 11/2004 Pucci ..... G08B 13/1427 340/539.32
2004/0222886 A1 11/2004 Davankov
2005/0225682 A1 10/2005 Glazier
2006/0109112 A1 * 5/2006 Haines ..... G01S 5/12 340/539.32
2007/0052534 A1 * 3/2007 Bird ..... G01S 13/878 340/539.13
2010/0085184 A1 4/2010 Cuttino
2011/0148625 A1 * 6/2011 Velusamy ..... G08B 13/1427 340/539.13
2015/0261986 A1 * 9/2015 Ekbatani ..... G06K 7/10366 340/8.1

* cited by examiner

*Primary Examiner* — George Bugg
*Assistant Examiner* — Renee Dorsey
(74) *Attorney, Agent, or Firm* — Kyle A. Fletcher, Esq.

(57) ABSTRACT

The remote control-finding device is a GPS based system that is used to locate household goods, include the remote controls for various audio visual devices, within a home. The remote control-finding device comprises a locating device and a plurality of tracking devices. The locating device is removably attached to a stationary item, such as a television, within the household while the each of the plurality of tracking devices are attached to the household good to be tracked. The locating device is fitted with a first GPS receiver that is used to track the position of the locating device. To find a tracked household good, the locating device queries an individual tracking device to receive the GPS location of the individual tracking device and uses that information to calculate the direction and distance from the locating device to the individual tracking device.

14 Claims, 7 Drawing Sheets

REMOTE CONTROL-FINDING DEVICE

CROSS REFERENCES TO RELATED APPLICATIONS

Not applicable

STATEMENT REGARDING FEDERALLY SPONSORED RESEARCH

Not applicable

REFERENCE TO APPENDIX

Not applicable

BACKGROUND OF THE INVENTION

Field of the Invention

The present invention relates to the field of navigation and position locating equipment, more specifically, a device configured for use in locating household items.

SUMMARY OF INVENTION

The remote control-finding device is a GPS based system that is used to locate household goods, include the remote controls for various audio visual devices, within a home. The remote control-finding device comprises a locating device and a plurality of tracking devices. The locating device is removably attached to a stationary item, such as a television, within the household while the each of the plurality of tracking devices are attached to the household good to be tracked. The locating device is fitted with a first GPS receiver that is used to track the position of the locating device. Each of the plurality of tracking devices is fitted with a second GPS receiver that tracks the position of the tracked household good. To find a tracked household good, the locating device is removed from the stationary item and one of a plurality of control buttons is pushed to select the household good is being searched for. The locating device communicates with the individual tracking device associated with the household good and receives from the individual tracking device associated with the household good the GPS location of the individual tracking device associated with the household good. The locating device then calculates the location of the individual tracking device associated with the household good relative to the locating device and displays the distance and a directional arrow on an LCD. A speaker is used to generate an audible beep that increases in frequency as the locating device mover closer to the individual tracking device associated with the household good. Once the desired household good has been located, the user pushes the previously selected button to complete the location process. The locating device then generates a repeated audible message to return the locating device to its initial position. When the GPS on the locating device senses that it has been returned to its original position, a celebratory audible signal is generated.

These together with additional objects, features and apparent to those of ordinary skill in the art upon reading the following detailed description of the presently preferred, but nonetheless illustrative, embodiments when taken in conjunction with the accompanying drawings.

In this respect, before explaining the current embodiments of the remote control-finding device in detail, it is to be understood that the remote control-finding device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the remote control-finding device.

It is therefore important that the claims be regarded as including such equivalent construction insofar as they do not depart from the spirit and scope of the remote control-finding device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
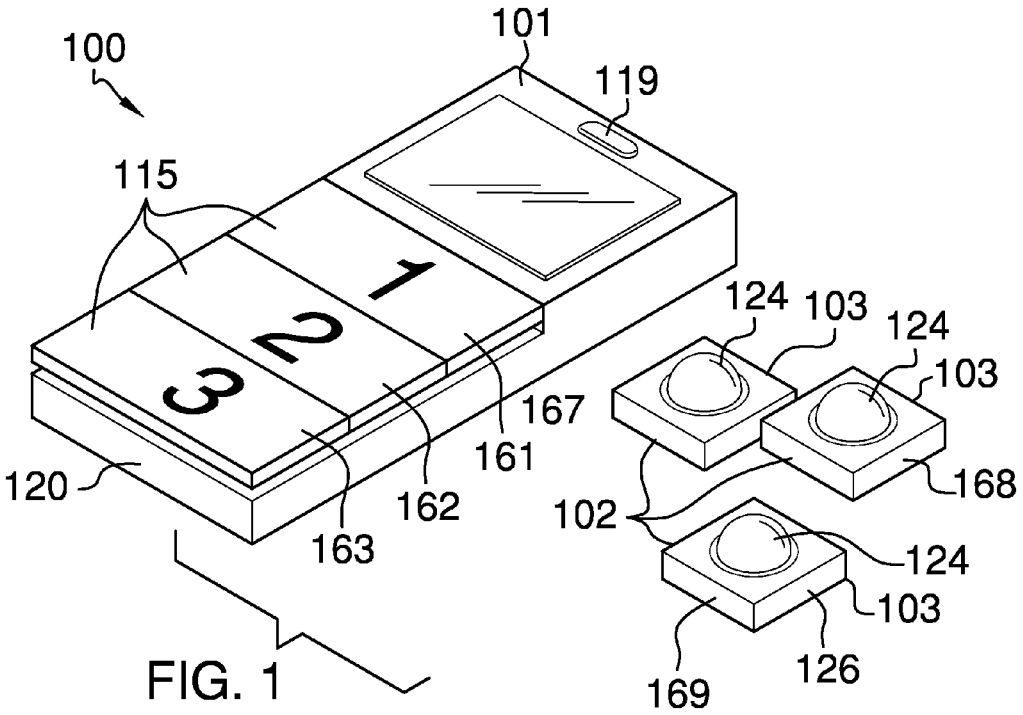
FIG. 1 is a perspective view of an embodiment of the disclosure.
Figure 2:
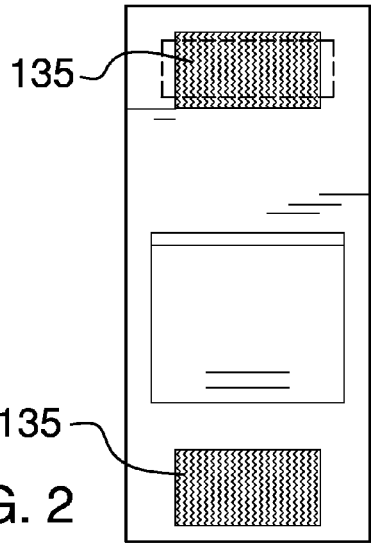
FIG. 2 is a back view of an embodiment of the disclosure.
Figure 3:
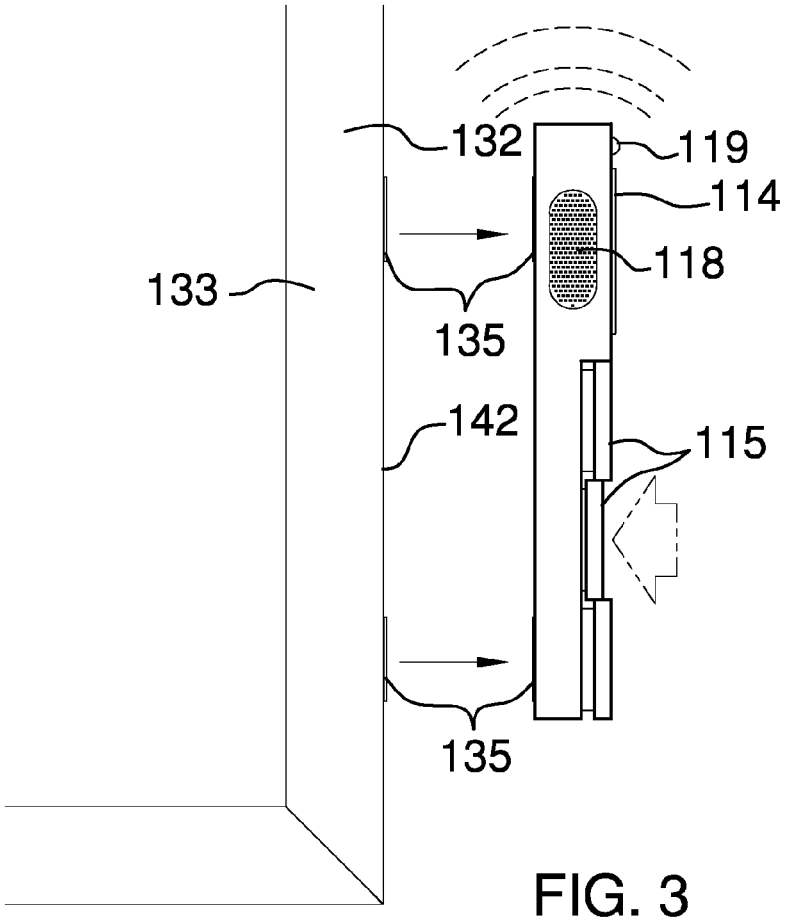
FIG. 3 is a side view of an embodiment of the disclosure.
Figure 4:
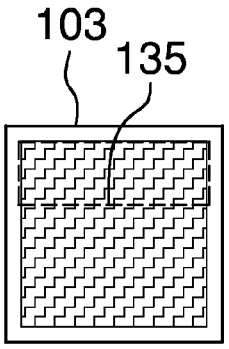
FIG. 4 is a detail view of an embodiment of the disclosure.
Figure 5:
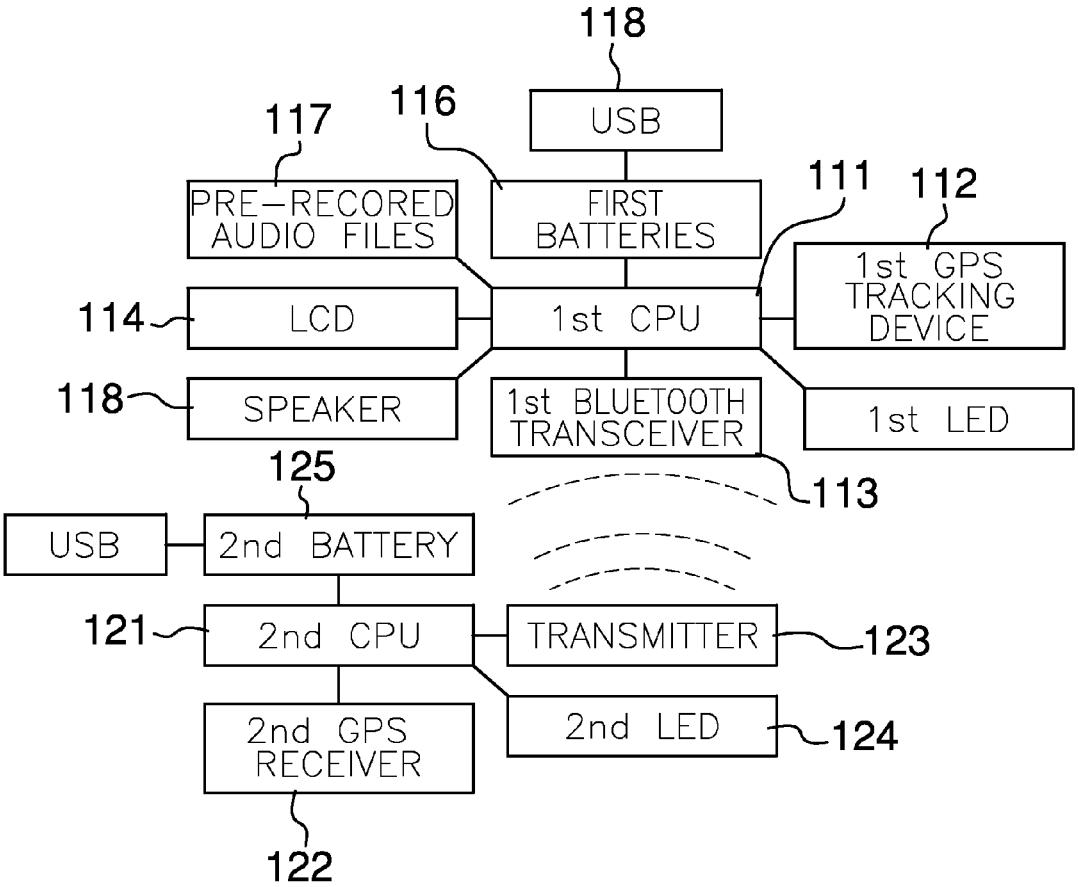
FIG. 5 is a block diagram view of an embodiment of the disclosure.
Figure 6:
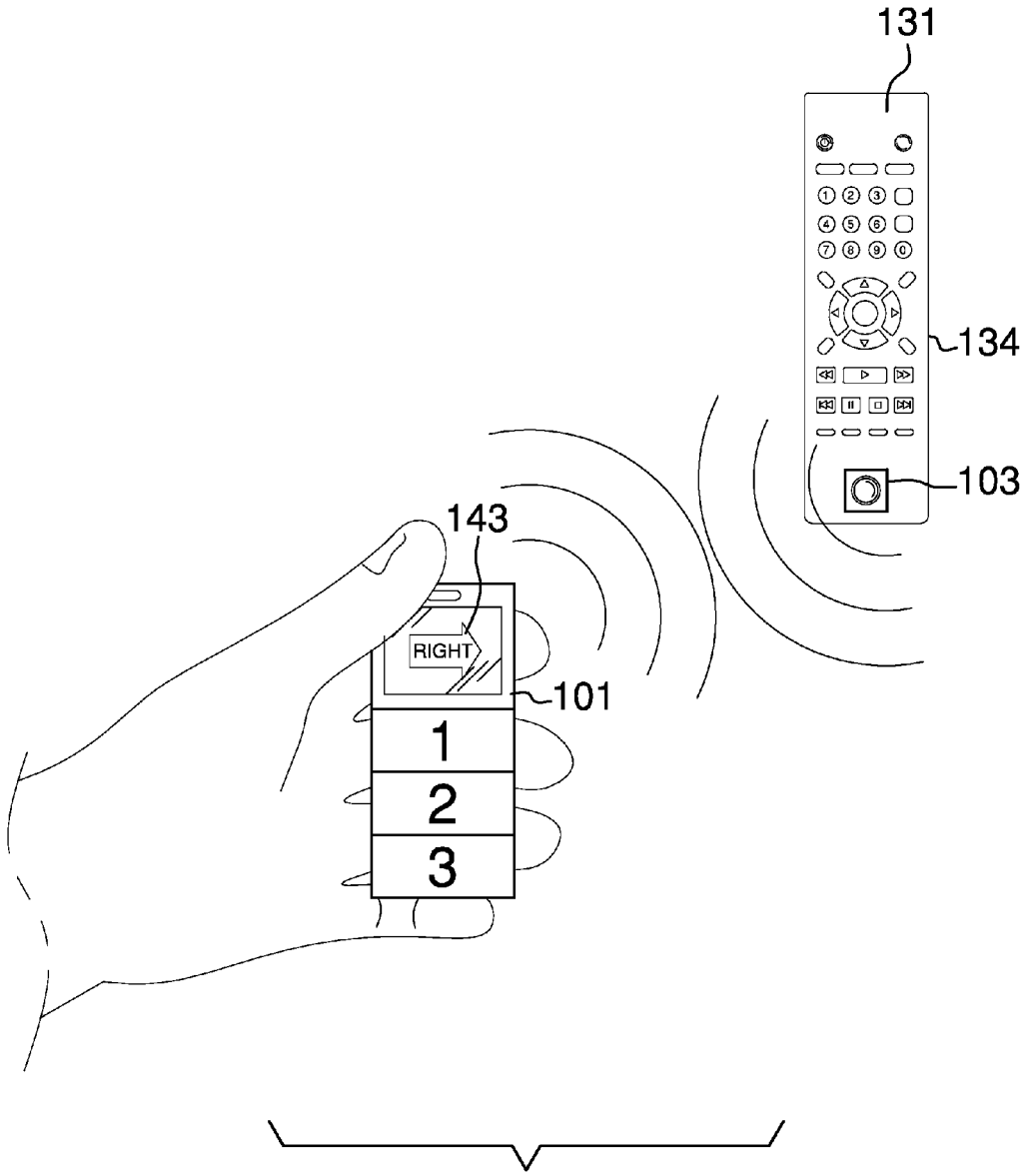
FIG. 6 is an in use view of an embodiment of the disclosure.
Figure 7:
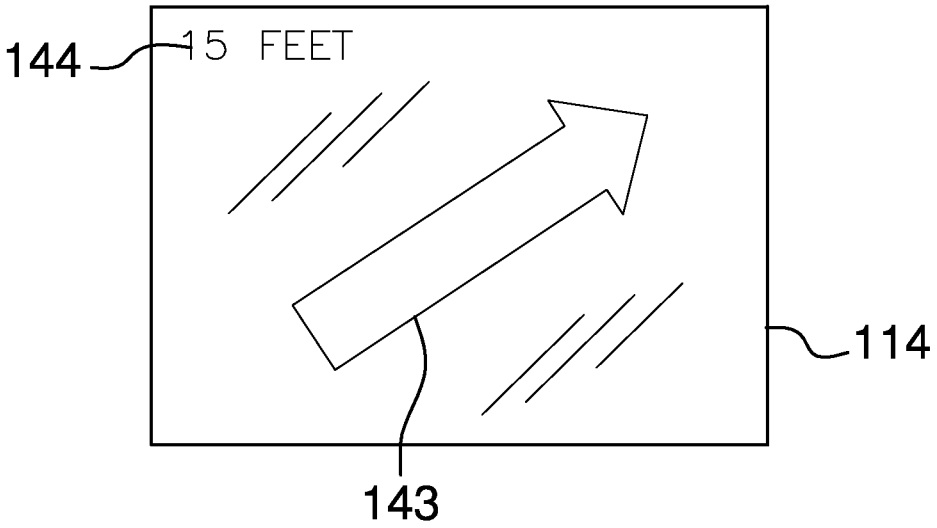
FIG. 7 is a detail view of an embodiment of the disclosure
Figure 8:
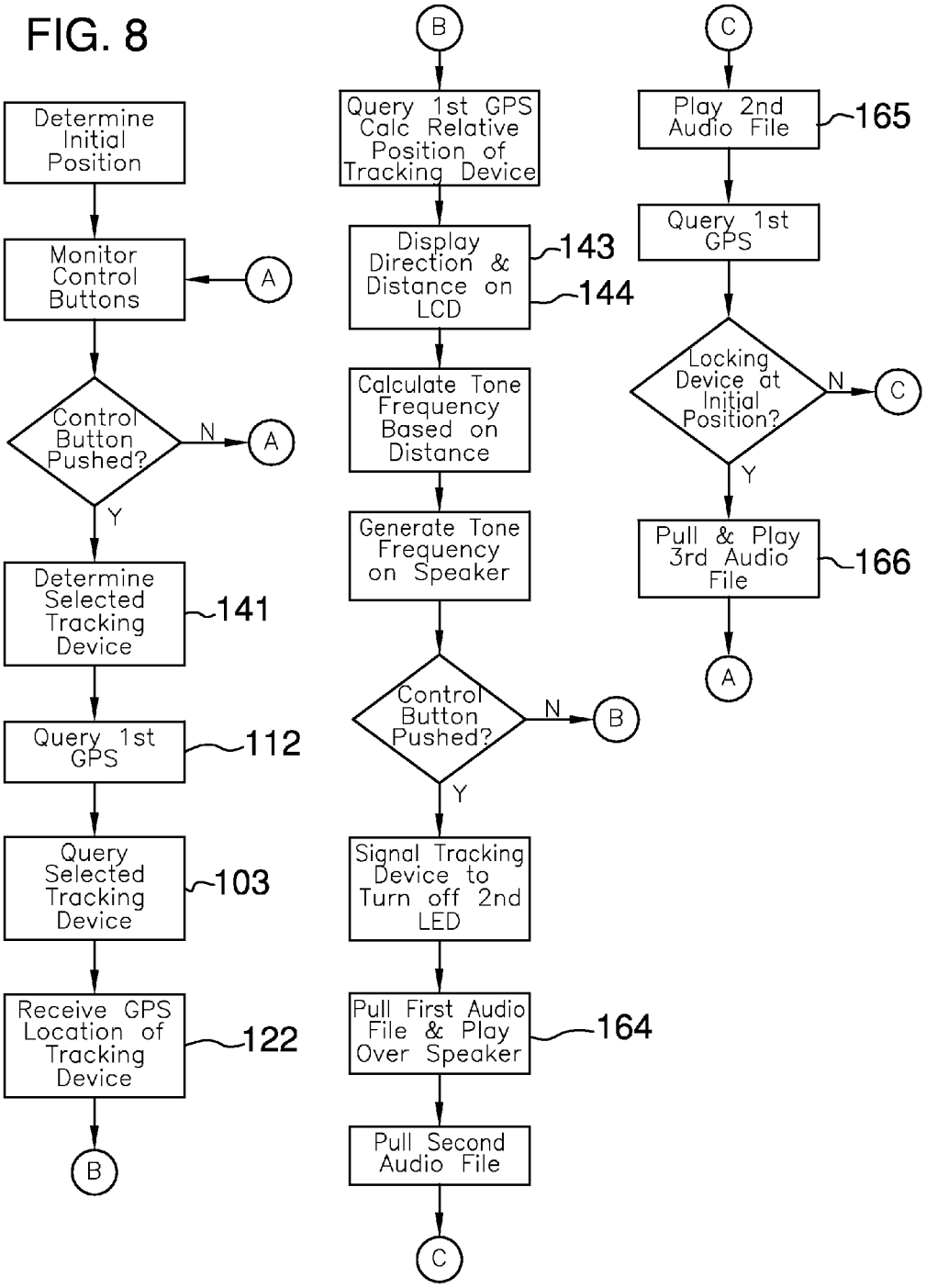
FIG. 8 is a flowchart view of an embodiment of the disclosure
Figure 9:
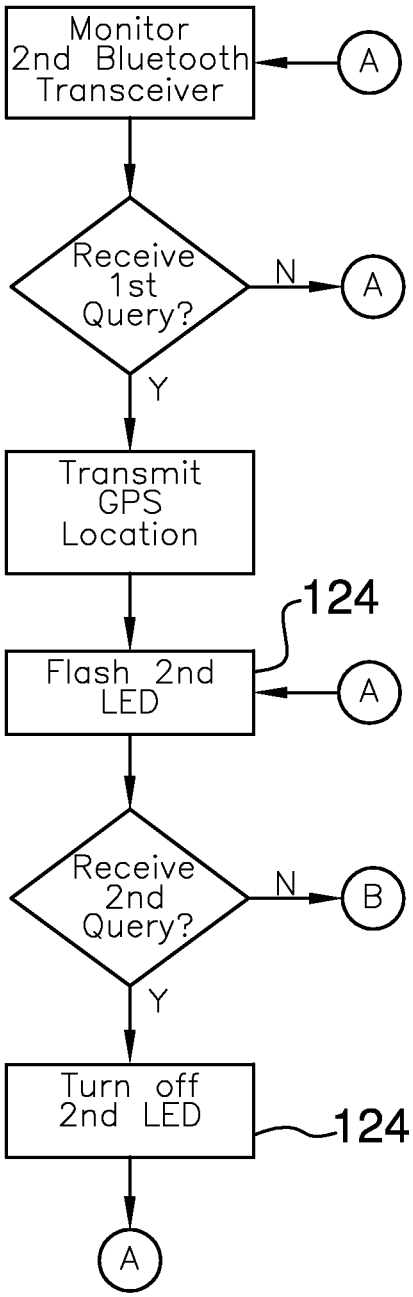
FIG. 9 is a flowchart view of an embodiment of the disclosure.

Detailed reference will now be made to a first potential embodiment of the disclosure, which is illustrated in FIGS. 1 through 9. The remote control-finding device is a GPS based system that is used to locate household goods 131, including the remote controls 134 for various audio visual devices, within a home. The remote control-finding device 100 (hereinafter invention) comprises a locating device 101 and a plurality of tracking devices 102.

The locating device 101 is removably attached to a stationary item 132, such as a television 133, within the household while the each of the plurality of tracking devices locating device 101 is fitted with a first GPS receiver 112 that is used to track the position of the locating device 101. Each of the plurality of tracking devices 102 is fitted with a second GPS receiver 122 that tracks the position of the tracked household good 131. To find a tracked household good 131, the locating device 101 is removed from the stationary item 132 and one of a plurality of control buttons 115 is pushed to select the household good 131 is being searched for. The locating device 101 communicates with the individual tracking device 103 associated with the household good 131 and receives from the individual tracking device 103 associated with the household good 131 the GPS location of the individual tracking device 103 associated with the household good 131. The locating device 101 then calculates the location of the individual tracking device 103 associated with the household good 131 relative to the locating device 101 and displays the distance 144 and a directional arrow 143 on an LCD 114.

A speaker 118 is used to generate an audible beep that increases in frequency as the locating device 101 moves closer to the individual tracking device 103 associated with the household good 131. Once the desired household good 131 has been located, the user pushes the previously selected button to complete the locating process. The locating device 101 then device 101 to its initial position 142. When the first GPS receiver 112 on the locating device 101 senses that the locating device 101 has been returned to the initial position 142, a celebratory audible signal is generated.

The locating device 101 further comprises a first microcontroller 111, the first GPS receiver 112, a first Bluetooth transceiver 113, an LCD display 114, a plurality of control buttons 115, a first battery 116, a plurality of audio files 117, a speaker 118, a first LED 119, and a first housing 120. The first microcontroller 111 controls the operation of the locating device 101. The first GPS receiver 112 monitors the GPS to determine the location of the locating device 101. The location of the stationary item 132 the locating device 101 is stored in first microcontroller 111 as the initial position 142 of the locating device 101. The first Bluetooth transceiver 113 is used to manage communications between the locating device 101 and each of the individual tracking devices 103. The plurality of control buttons 115 are a collection of switches that are monitored by the first microcontroller 111. Each of the plurality of control buttons 115 is associated with an individual tracking device 103 selected from the plurality of tracking devices 102.

When a button selected from the plurality of control the protocol to locate an individual tracking device 103 associated with the button selected from the plurality of control buttons 115 is pushed. Once the protocol to locate an individual tracking device 103 is initiated the first microcontroller 111 generates a frequency tone that is played over the speaker 118 giving an audible indication of the distance 144 to the individual tracking device 103. As the locating device 101 is mover closer to the individual tracking device 103, the frequency of the tone increases creating a higher pitch of sound. The first LED 119 acts as a signal lamp that is illuminated by the first microcontroller 111 to indicate that the protocol to locate an individual tracking device 103 has been initiated. The first battery 116 is a rechargeable battery that is used to power the locating device 101. The first battery 116 is recharged using a micro USB port. The first housing 120 is a rigid structure that encloses the first microcontroller 111, the first GPS receiver 112, the first Bluetooth transceiver 113, and the first battery 116. The LCD 114, the plurality of control buttons 115, the speaker 118 and the first LED 119 are mounted within on the first housing 120 so that they are accessible by the user.

The plurality of audio files 117 are digitally stored sounds that are accessed after the individual tracking device the individual tracking device 103 has been located when the individual control button from the plurality of control buttons 115 associated with the individual tracking device 103 has been pushed for a second time. Once the first microcontroller 111 determines that the individual tracking device 103 has been located, the first microcontroller 111 discontinues the LCD 114 display and turns off the first LED 119. The first microcontroller 111 sends a Bluetooth signal to the individual tracking device 103 to discontinue the second LED 124. The second LED 124 is discussed elsewhere in this disclosure. The first microcontroller 111 then processes a first audio file 164 selected from the plurality of audio files 117 to generate a predetermined celebratory signal over the speaker 118 to confirm that the individual tracking device 103 has been located. The first microcontroller 111 next processes a second audio file 165 selected from the plurality of audio files 117 to generate a reminder message played over the speaker 118 to return the locating device 101 to its initial position 142 by the stationary item 132.

The first microcontroller 111 repeats the reminder message until the first GPS receiver 112 indicates that the locating device 101 has been returned to the initial position 142. Once the first microcontroller 111 confirms that the locating device microcontroller 111 processes a third audio file 166 over the speaker 118 to indicate that the protocol to locate an individual tracking device 103 has been terminated.

The plurality of tracking devices 102 comprises a collection of individual tracking devices 103. Other than a unique identification code 141, each individual tracking device 103 is identical to the other individual tracking devices 103. Each individual tracking device 103 further comprises a second microcontroller 121, the second GPS receiver 122, a second Bluetooth transceiver 123, a second LED 124, a second battery 125, and a second housing 126. The second microcontroller 121 controls the operation of the individual tracking device 103. The second GPS receiver 122 monitors the GPS to determine the location of the individual tracking device 103. The second Bluetooth transceiver 123 is used to manage communications between the individual tracking devices 103 and the locating device 101.

When the locating device 101 queries the individual tracking device 103, the second microcontroller 121 obtains the location of the individual tracking device 103 from the second GPS receiver 122 and transmits the coordinates to the locating device 101 over the second Bluetooth transceiver 123. After transmitting its location, the second microcontroller 121 begins flashing the second LED 124 to act as a visual beacon to help locate the individual tracking device 103. The second microcontroller 121 continues to flash the second LED 124 until it receives a signal from the locating device 101 to discontinue flashing the second LED 124. The second battery 125 is a rechargeable battery that is used to power the individual tracking device 103. The second battery 125 is recharged using a micro USB port. The second housing 126 is a rigid structure encloses the second microcontroller 121, the second GPS receiver 122, the second Bluetooth transceiver 123, and the second battery 125. The second LED 124 is mounted on the second housing 126 such that it is visible to the user.

In the first potential embodiment of the disclosure, the first microcontroller 111 and second microcontroller 121 are Arduino based microcontrollers. The first GPS receiver 112, the second GPS receiver 122, the first Bluetooth transceiver 113 and the second Bluetooth transceiver 123 are commercially available Arduino shields. The plurality of audio files 117 are stored in a commercially available Arduino SD memory shield. The LCD 114, plurality of control buttons 115, first battery 116, second battery 125, first LED 119, second LED 124, and speaker 118 are readily and commercially available. Commercially available units were used for the first housing 120 and the second housing 126. The locating device 101 is attached to the stationary item 132 using readily and commercially available hook and loop fasteners 135. The plurality of tracking devices 102 further comprises a first individual tracking device 167, a second individual tracking device 168 and a third individual tracking device 169. The plurality of control buttons 115 further comprises a first control button 161, a second control button 162 and a third control button 163. The first individual tracking device 167 is associated with the first control button 161. The second individual tracking device 168 is associated with the second control button 162. The third individual tracking device 169 is associated with the third control button 163.

The following definitions were used in this disclosure:

Audio File: As used in this disclosure, an audio file is a digital representation of a sound that is used to store a recording of the sound. Separate hardware is used to convert the digital representation of the sound into an audible sound.

Battery: As used in this disclosure, a battery is a container consisting of one or more cells, in which chemical energy converted into electricity and used as a source of power.

GPS: As used in this definition, depending on the context GPS refers to: 1) a system of navigational satellites that are used to determine the position and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System.

Household Goods: As used in this disclosure, household goods are items contained within a household that are tangible and that are readily moved.

Housing: As used in this disclosure, a housing is a rigid casing that encloses and protects one or more devices.

LCD: As used in this disclosure, LCD is an acronym for Liquid Crystal Display. A liquid crystal display comprises a liquid crystal film placed between two sheets of transparent material. The visual characteristics of the can be varied through the application of a voltage.

LED: As used in this disclosure, an LED is an acronym for a light emitting diode. A light emitting diode is a 2 lead semiconductor that is also a light source.

Microcontroller: As used in this disclosure, a microcontroller is a programmable device that accepts digital and analog inputs, processes the digital and analog inputs according to previously stored instruction and to provide the results of these instructions as digital or analog outputs. A microcontroller is a small computer, often on a single rated circuit, containing a processor core, memory, and programmable input/output peripherals.

With respect to the above description, it is to be realized that the optimum dimensional relationship for the various components of the invention described above and in FIGS. 1 through 9, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A device for finding items comprising;

a locating device and a plurality of tracking devices;

wherein the device for finding items is adapted for use in finding a household good;

wherein the locating device is removably attached to a stationary item;

wherein each of the plurality of tracking devices further comprises a collection of individual tracking devices;

wherein each of the plurality of tracking devices is attached to the household good; wherein the locating device is fitted with a first GPS receiver;

wherein each of the plurality of tracking devices is fitted with a second GPS receiver;

wherein the locating device communicates with the individual tracking device associated with the household good;

wherein the locating device receives from the individual tracking device associated with the household good the GPS location of the individual tracking device associated with the household good;

wherein the locating device calculates the location of the individual tracking device associated with the household good relative to the locating device and displays the distance and a directional arrow on an LCD;

wherein the locating device further comprises a speaker that is used to generate an audible beep that increases in frequency as the locating device moves closer to the individual tracking device associated with the household good;

wherein the locating device further comprises a first microcontroller, the first GPS receiver, a first Bluetooth transceiver, an LCD display, a plurality of control buttons, a first battery, a plurality of audio files, the speaker, a first LED, and a first housing;

wherein the first microcontroller controls the operation of the locating device;

wherein the first GPS receiver determines an initial position of the locating device;

wherein the initial position of the locating device is stored in the first microcontroller;

wherein the plurality of control buttons are a collection of switches that are monitored by the first microcontroller;

wherein each of the plurality of control buttons is associated with an individual tracking device selected from the plurality of tracking devices;

wherein when a button selected from the plurality of control buttons is pushed, the first microcontroller initiates a protocol to locate the individual tracking device associated with the button selected from the plurality of control buttons that was pushed.

2. The device for finding items according to claim 1 wherein the first LED is illuminated by the first microcontroller to indicate that the protocol to locate an individual tracking device has been initiated.

3. The device for finding items according to claim 2 wherein the first battery is a rechargeable battery.

4. The device for finding items according to claim 3 wherein the first housing is a rigid structure that encloses the first microcontroller, the first GPS receiver, the first Bluetooth transceiver, and the first battery;

wherein the LCD, the plurality of control buttons, the speaker and the first LED are mounted within on the first housing so that they are accessible by a user.

5. The device for finding items according to claim 4 wherein the plurality of audio files are digitally stored by the microcontroller.

6. The device for finding items according to claim 5 wherein the plurality of audio files are accessed after the individual tracking device is located.

7. The device for finding items according to claim 6 wherein each individual tracking device further comprises a second microcontroller, the second GPS receiver, a second Bluetooth transceiver, a second LED, a second battery, and a second housing; wherein the second microcontroller controls the operation of the individual tracking device.

8. The device for finding items according to claim 7 wherein when the locating device queries the individual tracking device, the second microcontroller obtains the location of the individual tracking device from the second GPS receiver and transmits the coordinates to the locating device over the second Bluetooth transceiver.

9. The device for finding items according to claim 8 wherein second microcontroller flashes the second LED.

10. The device for finding items according to claim 9 wherein the second battery is a rechargeable battery.

11. The device for finding items according to claim 10 wherein the second housing is a rigid structure that encloses the second microcontroller, the second GPS receiver, the second Bluetooth transceiver, and the second battery;

wherein the second LED is mounted on the second housing such that it is visible to the user.

12. The device for finding items according to claim 11 wherein the locating device is attached to the stationary item using readily and commercially available hook and loop fasteners.

13. The device for finding items according to claim 12 wherein the plurality of tracking devices further comprises a first individual tracking device, a second individual tracking device and a third individual tracking device.

14. The device for finding items according to claim 13 wherein the plurality of control buttons further comprises a first control button, a second control button and a third control button;

wherein the first individual tracking device is associated with the first control button;

wherein the second individual tracking device is associated with the second control button;

wherein the third individual tracking device is associated with the third control button.

* * * * *